US011384464B2

(12) United States Patent
Kim et al.

(10) Patent No.: US 11,384,464 B2
(45) Date of Patent: Jul. 12, 2022

(54) WASHING MACHINE

(71) Applicant: LG ELECTRONICS INC., Seoul (KR)

(72) Inventors: Jaehong Kim, Seoul (KR); Hyoeun Kim, Seoul (KR); Taeho Lee, Seoul (KR); Hangil Jeong, Seoul (KR); Jongwoo Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 138 days.

(21) Appl. No.: 16/600,311

(22) Filed: Oct. 11, 2019

(65) Prior Publication Data

US 2020/0190721 A1 Jun. 18, 2020

Related U.S. Application Data

(63) Continuation of application No. PCT/KR2018/015957, filed on Dec. 14, 2018.

(51) Int. Cl.

| | |
|---|---|
| ***D06F 33/00*** | (2020.01) |
| ***D06F 34/28*** | (2020.01) |
| *D06F 101/00* | (2020.01) |

(52) U.S. Cl.

CPC ..... *D06F 33/00* (2013.01); *D06F 34/28* (2020.02); *D06F 2101/00* (2020.02)

(58) Field of Classification Search

None

See application file for complete search history.

(56) References Cited

U.S. PATENT DOCUMENTS

| | | | | |
|---|---|---|---|---|
| 2001/0049846 | A1* | 12/2001 | Guzzi | D06F 34/22 8/158 |
| 2014/0337257 | A1 | 11/2014 | Chatterjee et al. | |
| 2016/0258104 | A1 | 9/2016 | James | |
| 2016/0312396 | A1 | 10/2016 | Cruickshank et al. | |
| 2018/0165744 | A1 | 6/2018 | Bajovic | |
| 2018/0305851 | A1* | 10/2018 | Kwon | D06F 34/05 |

FOREIGN PATENT DOCUMENTS

| | | |
|---|---|---|
| CN | 105970547 | 9/2016 |
| KR | 1020080079913 | 9/2008 |
| KR | 1020180119486 | 11/2018 |
| WO | 2015055239 | 4/2015 |

OTHER PUBLICATIONS

PCT International Application No. PCT/KR2018/015957, Written Opinion of the International Searching Authority dated Aug. 23, 2019, 8 pages.

European Patent Office Application Serial No. 119214151.3, Search Report dated Mar. 18, 2020, 10 pages.

* cited by examiner

*Primary Examiner* — Cristi J Tate-Sims

(74) *Attorney, Agent, or Firm* — Lee, Hong, Degerman, Kang & Waimey PC

(57) ABSTRACT

Disclosed herein is a washing machine including a first data acquirer configured to collect data related to a laundry pattern of a user, a second data acquirer configured to collect data related to context information, and a processor configured to provide the laundry pattern of the user and the context information to a reinforcement learning model as an environment and to train the reinforcement learning model using feedback of the user on a recommended laundry course when the reinforcement learning model recommends the laundry course.

9 Claims, 12 Drawing Sheets

FIG. 6
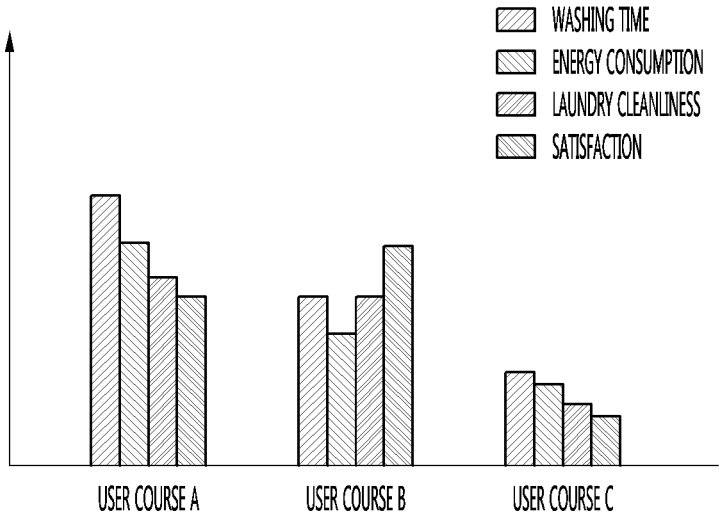
(a)
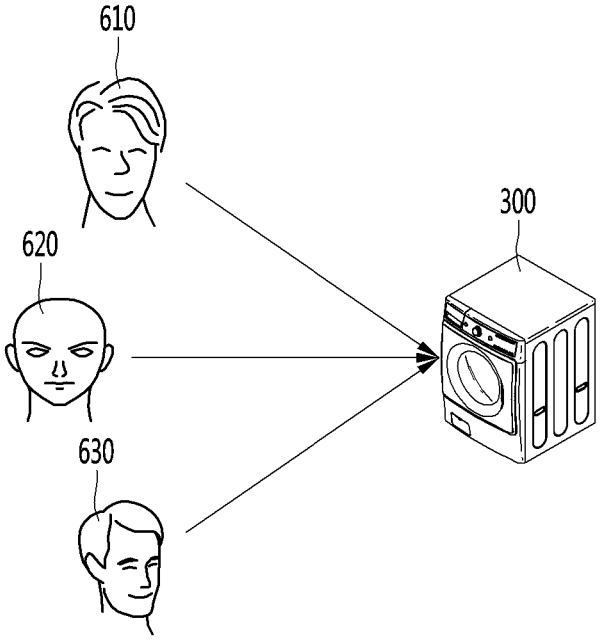
(b)

FIG. 7

| USER'S PREFERRED LAUNDRY PATTERN INFORMATION | | | | | | |
|---|---|---|---|---|---|---|
| WASH (NUMBER OF TIMES) | RINSE (NUMBER OF TIMES) | DEHYDRATION (NUMBER OF TIMES) | BOILING (NUMBER OF TIMES) | WATER TEPERATURE (DEGREE) | PREFERRED COURSE | WASHING TIME (NUMBER) |
| 3 | 4 | 3 | 0 | 50 | NORMAL | 80 |
| 2 | 3 | 1 | 0 | 30 | WOOL COURSE | 51 |
| 1 | 2 | 2 | 2 | 70 | BOILING | 95 |

(a)

| USER'S PREFERRED LAUNDRY PATTERN INFORMATION | | | | | | |
|---|---|---|---|---|---|---|
| WASH (NUMBER OF TIMES) | RINSE (NUMBER OF TIMES) | DEHYDRATION (NUMBER OF TIMES) | BOILING (NUMBER OF TIMES) | WATER TEPERATURE (DEGREE) | PREFERRED COURSE | WASHING TIME (NUMBER) |
| [0100] | [0010] | [0001] | [0100] | 0.422137617 | [00001] | 0.432902506 |
| [0010] | [0100] | [0100] | [0001] | 0.984831673 | [01000] | 0.106933439 |
| [0001] | [0001] | [1000] | [0001] | 0.33548587 | [10000] | 0.905862421 |
| [0010] | [0100] | [0100] | [0001] | 0.157649801 | [01000] | 0.166030248 |
| [0001] | [0001] | [1000] | [0001] | 0.944186501 | [10000] | 0.902002173 |
| [0010] | [0100] | [0100] | [0001] | 0.069825752 | [01000] | 0.418622566 |
| [0001] | [0001] | [1000] | [0001] | 0.204009565 | [10000] | 0.555561032 |
| [0010] | [0100] | [0100] | [0001] | 0.677521671 | [01000] | 0.691152923 |

(b)

| WASHING INFORMATION | | | | | | |
|---|---|---|---|---|---|---|
| CLOTH | WASHING MACHINE WASHING | HAND WASHING | WATER WASHING | DETERGENT TYPE | BOILING | WATER TEMPERATURE |
| COTTON, POLYESTER | ○ | ○ | ○ | All | ○ | 40 |
| WOOL, POLYURETHANE | ○ | ○ | × | ONLY NEUTRAL DETERGENT | | 30 |
| PURE CUTTON | ○ | × | × | All | ○ | 95 |

(a)

| WASHING INFORMATION | | | | | | |
|---|---|---|---|---|---|---|
| CLOTH | WASHING MACHINE WASHING | HAND WASHING | WATER WASHING | DETERGENT TYPE | BOILING | WATER TEMPERATURE |
| [000000000001] | [1] | [1] | [1] | [010] | [010] | 0.957458038 |
| [000000100000] | [1] | [1] | [0] | [010] | [010] | 0.513836085 |
| [000000001000] | [1] | [0] | [1] | [100] | [100] | 0.234165823 |
| [000000100000] | [0] | [1] | [0] | [010] | [010] | 0.476487202 |
| [000000001000] | [1] | [1] | [1] | [100] | [100] | 0.116580986 |
| [000000100000] | [1] | [1] | [0] | [010] | [010] | 0.925404626 |
| [000000001000] | [1] | [0] | [1] | [100] | [100] | 0.830538191 |
| [000000100000] | [0] | [1] | [0] | [010] | [010] | 0.806409469 |

(b)

WASHING MACHINE

CROSS-REFERENCE TO RELATED APPLICATIONS

This application is a continuation of International Application No. PCT/KR2018/015957, filed on Dec. 14, 2018, the contents of which are all incorporated by reference herein its entirety.

BACKGROUND

Field of the Invention

The present invention relates to a washing machine for recommending a laundry course suitable for a laundry pattern of a user and a situation through reinforcement learning.

Discussion of the Related Art

Artificial intelligence is a field of computer engineering and information technology involving studying how computers can think, learn and self-develop in ways similar to human intelligence, and means that computers can emulate intelligent actions of humans.

In addition, artificial intelligence does not exist by itself but is directly or indirectly associated with the other fields of computer science. In particular, many attempts have been made to introduce elements of artificial intelligence into various fields of information technology.

Meanwhile, technologies for perceiving and learning surrounding situations using artificial intelligence and providing information desired by a user in a desired form or performing an operation or function desired by the user have been actively studied.

A washing machine provides various laundry courses. The laundry courses provided by the washing machine are set by a manufacturer according to the type of laundry, a washing time, etc., which do not consider requirements of various users.

For example, a user A who is a busy office worker may prefer quick washing and a user B who a housewife responsible for the health of the family may prefer clean washing. In addition, a user C who frequently takes exercise may prefer washing capable of eliminating smell of sweat and a user D who raise a child may prefer washing using a boiling function.

However, it is impossible to satisfy the requirements of various users only using the laundry courses provided by the manufacturer of the washing machine.

In addition, the laundry course suitable for the same user may vary depending on situations. For example, the user C who frequently takes exercise may prefer washing capable of eliminating smell of sweat after a workout, but may prefer quick washing when washing a dress shirt worn upon going to work.

Accordingly, there is a need to recommend an appropriate laundry course to a user in consideration of user's preference and situation.

SUMMARY

An object of the present invention is to provide a washing machine for recommending a laundry course suitable for a laundry pattern of a user and a situation through reinforcement learning.

A washing machine according to an embodiment of the present invention includes a first data acquirer configured to collect data related to a laundry pattern of a user, a second data acquirer configured to collect data related to context information, and a processor configured to provide the laundry pattern of the user and the context information to a reinforcement learning model as an environment and to train the reinforcement learning model using feedback of the user on a recommended laundry course when the reinforcement learning model recommends the laundry course.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

FIG. 6 is a view illustrating a method of collecting a laundry pattern of each user.

FIG. 7 is a view illustrating a preprocessing procedure of a laundry pattern.

DETAILED DESCRIPTION OF THE EMBODIMENTS

Figure 1A:
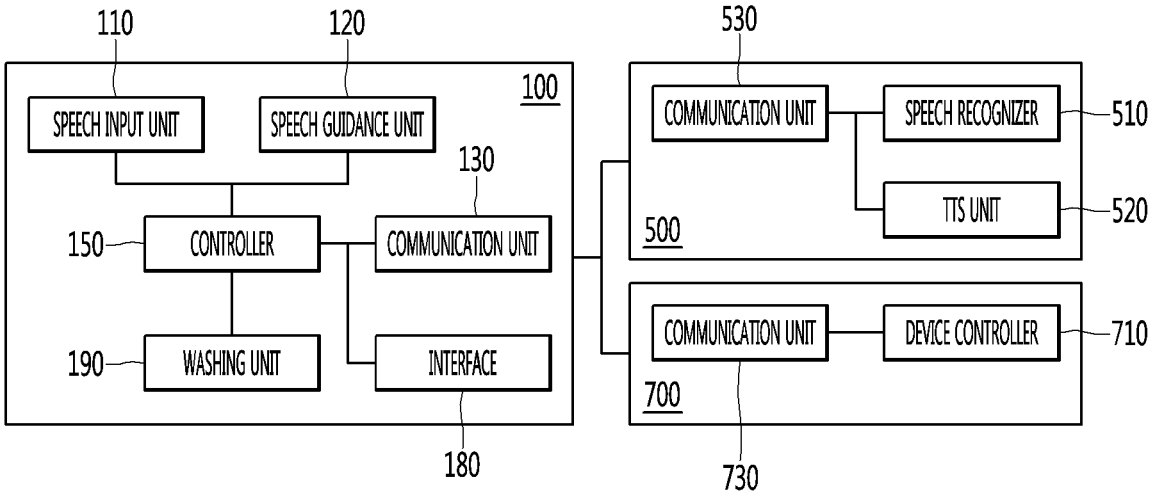
FIG. 1*a* is a diagram showing the configuration of a washing machine according to an embodiment of the present invention.

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Although components are subdivided and described for convenience of description in implementation of the present invention, these components may be implemented in one device or module or one component may be divided into a plurality of devices or modules.

In this specification, devices for performing functions necessary to wash, dry or dry-clean clothes, bedclothes, dolls, etc. are collectively referred to as washing machines. That is, in this specification, objects including cloth, such as clothes, bedclothes and dolls, are collectively laundry. In addition, in this specification, in this specification, all devices for washing and drying laundry, removing dust or performing dry cleaning are collectively referred to as washing machines and these devices are not limited to washing machines having only washing performance.

In this specification, a user may input information on laundry interactively with a washing machine in a process of putting laundry into the washing machine, and the washing machine may extract meaningful information from the received information and select a laundry course suitable for the laundry.

FIG. 1*a* is a diagram showing the configuration of a washing machine according to an embodiment of the present invention. FIG. 1*a* shows the structure of a washing machine for recognizing speech using a speech server disposed outside the washing machine and selecting a course.

The washing machine 100 includes a speech input unit 110, a speech guidance unit 120, a communication unit 130, an interface 180 and a washing unit 190.

The washing machine 100 transmits the received speech data to a speech server 500 and the speech server 500 analyzes the speech data to determine which speech is input. In addition, in a central control server 700, a device controller 710 may generate a control command for controlling the washing machine 100 based on the analyzed speech data and transmit the control command to the washing machine 100 through a communication unit 730 to control the washing machine 100. The interface 180 provides a function for outputting predetermined information and receiving touch input or button input capable of performing operation such as menu selection from a user.

Operation of the components will be described in greater detail.

The speech input unit 110 receives speech including at least one of a StainWord indicating contaminant or a ClothWord indicating laundry from the user and generates speech data.

The speech input unit 110 may be a microphone. In one embodiment, the speech input unit 110 may include one or more microphones in order to receive only the speech of the user. The speech input unit 110 may include one or more microphones and further include a noise removal module. In this case, the speech input unit 110 may extract and convert only speech into speech data and then transmit the speech data to the speech server 500 through the communication unit 130.

The communication unit 130 may transmit the speech data generated from the speech input through the speech input unit 110 and identification information of the washing machine 100 to a first server and receives course setting information from any one of the first server or a second server different from the first server.

The washing unit 190 includes components for providing a washing function. The washing unit may provide watering, draining, washing and rinsing functions.

If the server communicating with the washing machine 100 is the speech server 500 and the central control server 700 as shown in FIG. 1, the first server may be the speech server 500 and the second server may be the central control server 700. In this case, the communication unit 130 may receive the course setting information from the central control server 700 and separately communicate with the speech server 500 for speech recognition.

In addition, if the speech server 500 and the central control server 700 are unified to one server, the communication unit 130 may perform communication with the unified server. Providing one or a plurality of servers, or dividing one server or unifying several servers according to function are included in various embodiments and the present invention is not limited to one of the embodiments.

Meanwhile, the speech recognizer 510 of the speech server 500 recognizes the speech data received from the washing machine 100. In this process, the speech server 500 performs automatic speech recognition (ASR) and natural language processing (NLP) with respect to the speech data and extract meaningful words. The extracted words are transmitted to the central control server 700. The central control server 700 grasps the control intention of the user and remotely controls the washing machine 100.

The device controller 710 generates a control command suitable for the control intention of the user, that is, the course setting information necessary for washing, and transmits the control command to the washing machine 100 through the communication unit 730. In this process, the washing machine 100 may directly output the command through the speech guidance unit 120 in order to execute the received command, that is, to wash laundry according to a specific laundry course. Alternatively, when the speech data to be output from the text-to-speech unit of the speech server 500 is generated and provided to the washing machine 100 through the communication unit 530, the washing machine 100 may output the received speech data and guide the laundry course to the user.

In summary, when the laundry course is set according to the speech received by the speech input unit 110, the speech guidance unit 120 may output a speech guidance message guiding the laundry course corresponding to the course setting information.

Here, the course setting information may include a combination of the spin of the washing machine, the temperature of water, the type of detergent, the amount of detergent or the soil level of the laundry. Such course setting information may be displayed through the interface 180 and may be selected by the user.

The interface 180 generates audio, video or tactile output and may include at least one of a display or an audio output unit.

The display displays (outputs) information processed by the washing machine. For example, the display may display execution screen information of an application program executed by the washing machine or user interface (UI) or graphical user interface (GUI) information according to the executed screen information.

The display may have an inter-layered structure or an integrated structure with a touch sensor in order to realize a touchscreen. The touchscreen may provide an output interface between the washing machine and a user, as well as function as the user input unit which provides an input interface between the washing machine and the user.

The audio output module may output audio data received from the outside or stored in the memory. The audio output unit may output human voice.

The audio output module may also include a receiver, a speaker, a buzzer, or the like. The controller 150 may control these components. In particular, the controller may control the washing machine 100 such that the washing machine 100 operates based on the course setting information received by the communication unit 130.

If the configuration of the washing machine 100 of FIG. 1*a* is applied, an optimal laundry course may be set through interactive speech recognition. For example, even if the user does not know laundry course settings and options supported by the washing machine 100, when the user informs the washing machine of the type of contaminants such as grass, coffee or ketchup and the type of cloth in an interactive manner, it is possible to set and recommend an optimal laundry course and option.

That is, laundry course setting information may be collected using an interactive speech recognition method, may be automatically set as an optimal course provided by the washing machine by a laundry course conversion process, and may be recommended to the user through a speech synthesizer.

500 and 700 of FIG. 1*a* may be implemented separately from the washing machine 100 or integrally with the washing machine 100. Alternatively, one or more components configuring the speech server 500 and the central control server 700 may be included in the washing machine 100.

Figure 1B:
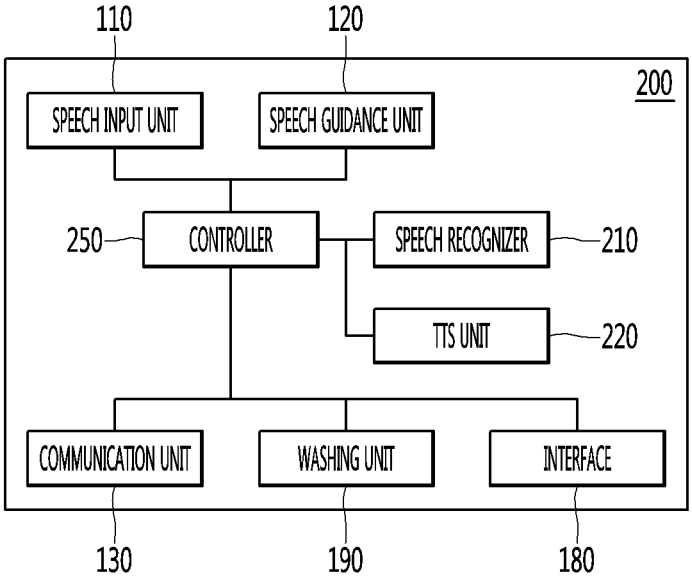
FIG. 1*b* is a diagram showing the configuration of the case where all components of a washing machine according to another embodiment are unified.

FIG. 1*b* is a diagram showing the configuration of the case where all components of a washing machine according to another embodiment are unified.

The speech recognizer 210 of the washing machine 200 of FIG. 1*b* provides the function of the speech recognizer 510 of the speech server 500 shown in FIG. 1*a*. The TTS unit 220 of the washing machine 200 of FIG. 1*b* provides the function of the TTS unit 520 of the speech server 500 of FIG. 1*a*. In addition, the controller 250 of the washing machine 200 provides the function of the device controller 710 of the central control server 700 of FIG. 1*a*. For the functions provided by the components, refer to the description of FIG. 1*a*.

FIGS. 1*a* and 1*b* are distinguished depending on whether the speech recognition and TTS function and the device control function are included in an external server or a washing machine. Unlike FIGS. 1*a* and 1*b*, only some functions may be included in the server. The present invention includes these various embodiments.

Figure 2A:
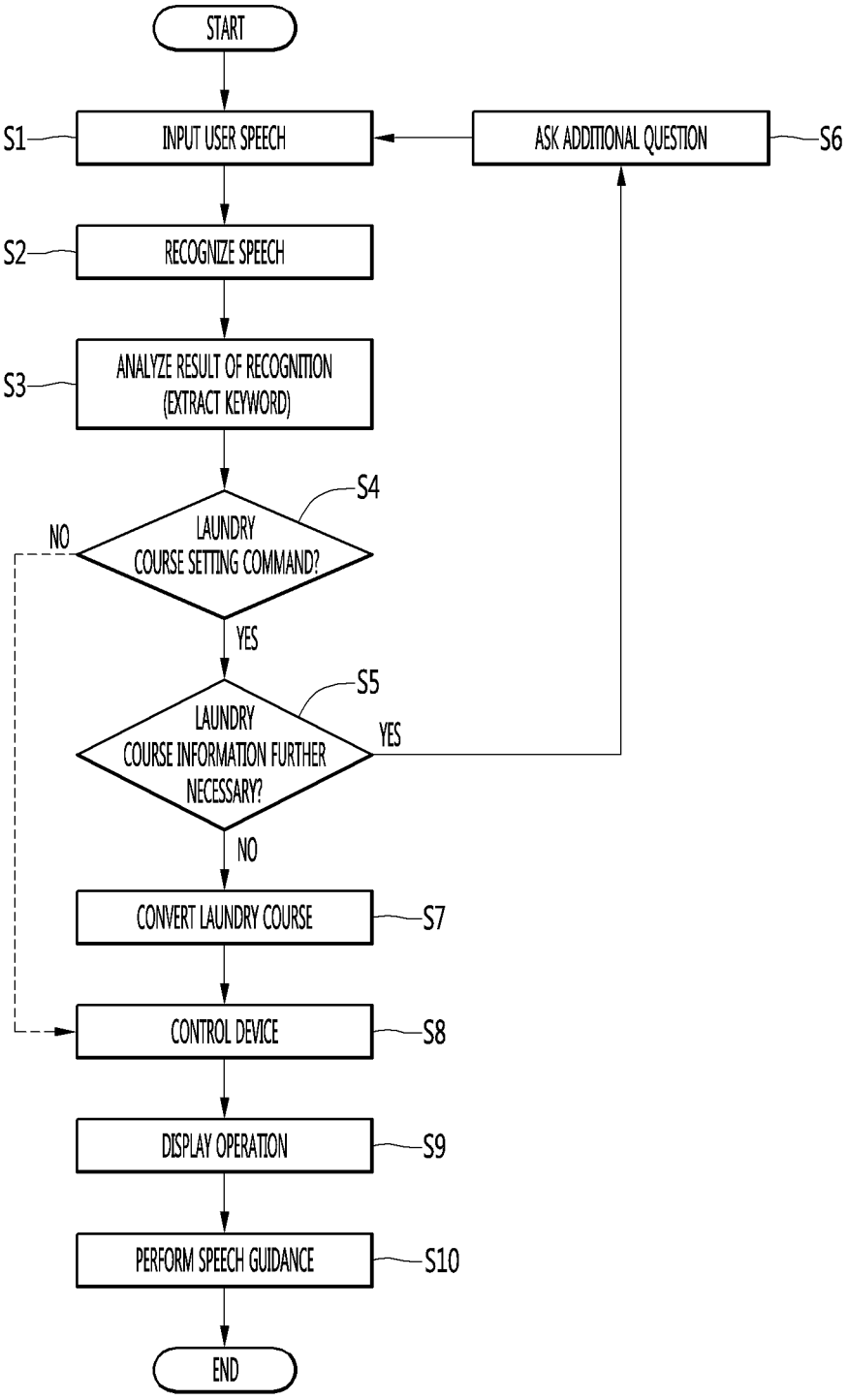
FIG. 2*a* is a flowchart illustrating a method of operating a washing machine according to an embodiment of the present invention.

FIG. 2*a* is a flowchart illustrating a method of operating a washing machine according to an embodiment of the present invention.

The user inputs speech around the washing machine 100 or 200 (S1). The input speech is converted into speech data and a speech recognition process is performed.

In FIG. 1*a*, the speech received by the speech input unit 110 of the washing machine 100 is converted into the speech data, the speech data is transmitted to the speech server 500 through the communication unit 130 of the washing machine 100, and the speech recognizer 510 of the speech server 500 analyzes the speech data perform speech recognition (S2).

In FIG. 1*b*, the speech received by the speech input unit 110 of the washing machine 200 is converted into the speech data and the speech recognizer 510 of the washing machine 200 analyzes the speech data to perform speech recognition (S2).

Text as the speech recognition result is generated in step S2. When text is generated, the device controller 710 of the central control server 700 or the controller 250 of the washing machine 200 analyzes the intention of the user based on the text. The device controller 710 of the central control server 700 or the controller 250 of the washing machine 200 extracts a keyword suitable for operation of the washing machine 100 or 200, by analyzing the speech recognition result (S3).

The device controller 710 of the central control server 700 or the controller 250 of the washing machine 200 determines whether there is a previous laundry course setting command (S4), when the keyword is extracted. In the case where simple device control such as on/off is performed instead of laundry course setting, the method may move to step S8 and operation corresponding to the device control may be performed.

Meanwhile, upon determining that there is a setting command, the device controller 710 or the controller 250 determines whether there is more information necessary for the laundry course, that is, whether additional laundry course information is further necessary (S5). If so, the speech guidance unit 120 may be controlled to ask an additional question (S6). In this case, steps S1 to S5 may be repeated.

If information necessary to set the laundry course is sufficiently obtained (S5), the device controller 710 or the controller 250 converts the laundry course (S7) and controls the device, that is, the washing machine, based on the converted washing machine (S8). Thereafter, the washing machine 100 or 200 displays a description of the course to be performed through the interface 180 (S9), and the speech guidance unit 120 performs speech guidance of the course (S10).

Operation of FIG. 2*a* will now be described.

The speech recognition server 500 or the speech recognizer 210 receives speech uttered by the user and generates a text result and the central control server 700 or the controller 250 of the washing machine 200 analyzes the text result and continuously asks additional questions for setting an optimal laundry course in an interactive manner to obtain desired information when the text result is a command for setting the laundry course. If no additional information is necessary, the laundry course conversion module sets and recommends the optimal laundry course.

In steps S4, S8, S9 and S10 of FIG. 2*a*, in the case of simple device control such as on/off, the device may be controlled, the controlled result is displayed on a screen, and feedback may be provided through a speech guidance message.

In FIG. 2*a*, step S4 may be selectively included. In addition, a predetermined number of questions may be repeatedly received in step S5. Accordingly, steps S4 and S5 may be selectively included.

Figure 2B:
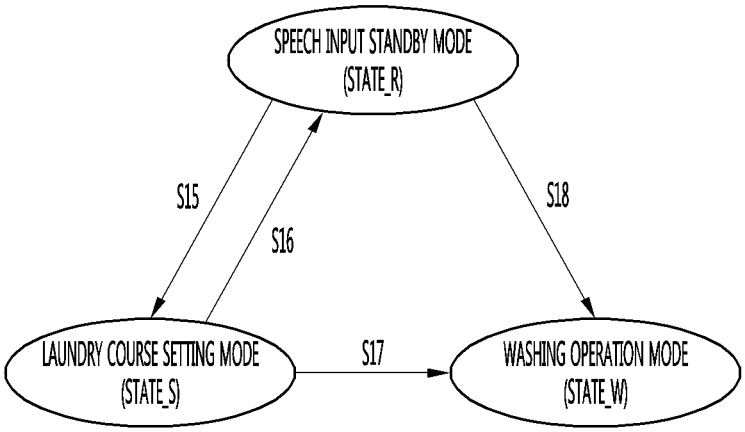
FIG. 2*b* is a diagram showing states of a washing machine according to an embodiment of the present invention.

FIG. 2*b* is a diagram showing states of a washing machine according to an embodiment of the present invention. The washing machine 100 or 200 shown in FIG. 1*a* or 2*b* enters a speech input standby mode STATE_R when power is turned on. When speech is input in this mode, a mode STATE_S for setting the laundry course in correspondence with speech input S15 is maintained. In this process, if information is sufficiently obtained, the state is changed to a washing operation mode STATE W (S17). However, if information is not sufficiently obtained, the state is changed from the setting mode STATE_S to the speech input standby mode STATE_R (S16).

Alternatively, in the speech input standby mode STATE_R, the user may control the interface 180 to control operation of the washing machine without separate speech input (S18).

If it is difficult for the user to easily select a laundry course based on the operation and state of the washing machine (if it is difficult to determine which washing type is necessary, which course is selected, or which option is selected), when the user inputs the features of laundry such as the type of contaminants (grass, coffee, ketchup, etc.) and the type of cloth (sportswear, baby clothes, underwear, etc.) to the washing machine 100 or 200 by speech in an interactive manner, the washing machine may select an optimal laundry course from the received speech data, displays a recommended laundry course, and guide washing.

As described in FIGS. 2*a* and 2*b*, using the speech recognition function of the washing machine or the server connected to the washing machine, the information for setting the optimal laundry course, such as the type of contaminant, the type of cloth, etc. of the laundry to be washed by the user, may be interactively acquired in a question-and-answer manner, thereby setting the optimal laundry course.

To this end, the user may utter the type of contaminant and, in response, the washing machine may perform speech guidance requesting the type of cloth. When the user utters the type of cloth, the washing machine may perform speech guidance requesting the degree of contamination. When the user utters high/middle/low as the degree of contamination, the washing machine finds an optimally recommended course through information such as the received contaminant information, the type of the cloth of the laundry, the degree of contamination or a time when the laundry is contaminated, provides a guidance message to the user through the speech guidance unit, and provide a laundry course suitable for user's intention.

Figure 2C:
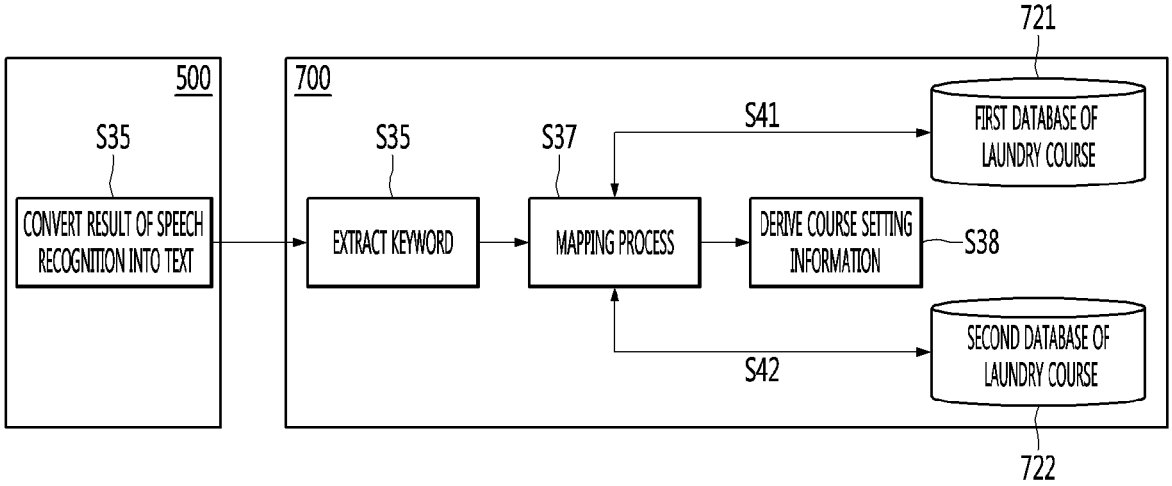
FIG. 2*c* is a diagram showing a process of setting a laundry course based on input washing information according to an embodiment of the present invention.

FIG. 2*c* is a diagram showing a process of setting a laundry course based on input washing information according to an embodiment of the present invention. The process of FIG. 2*c* may be performed by the device controller 710 of the central control server 700 or the controller 250 of the washing machine 200.

Operation of the central control server 700 will be described with reference to FIG. 2*c*. As described above in FIG. 1, the device controller 710 of the central control server 700 retrieves course setting information of the washing machine from a database using a first keyword corresponding to the StainWord, a second keyword corresponding to the ClothWord and the identification information of the washing machine. The StainWord may indicate the name of the contaminant, the color of the contaminant or the chemical characteristics of the contaminant. The ClothWord may include any one of the type of the laundry, the cloth name of the laundry or the color of the laundry.

The first keyword may be equal to the StainWord, and may be a word extracted from the StainWord or specifically mapped to the StainWord. Similarly, the second keyword may be equal to the ClothWord, and may be a word extracted from the ClothWord specifically mapped to the ClothWord.

In one embodiment, the user may utter "ketchup" in order to input the StainWord. At this time, the speech server 500 or the central control server 700 may obtain the first keyword "ketchup" from this word. In another embodiment, the user may utter "skirt" in order to input the ClothWord. At this time, the speech server 500 or the central control server 700 may obtain the second keyword "skirt" from this word.

That is, in one embodiment, the keyword is the StainWord or the ClothWord extracted from the received speech. In another embodiment, the keyword is a word mapped or extracted based on the StainWord or the ClothWord extracted from the received speech.

As shown in FIG. 2*c*, the device controller 710 retrieves course setting information from the databases 721 and 722 using the keywords. The communication unit 730 of the central control server 700 may transmit the retrieved course setting information to the washing machine 100 such that the washing machine 100 operates based on the course setting information.

The speech server 500 of FIG. 2*c* recognizes the received speech and converts the speech data into text. The converted text data (e.g., a text file) is transmitted to the central control server 700, and the device controller 710 of the central control server 700 extracts the keyword based on the device (washing machine) to which the speech is input (S36), in order to extract the keyword suitable for the corresponding device if the central control server 700 controls various types of devices.

The central control server 700 may retrieve the laundry course corresponding to the extracted keyword. In FIG. 6, in one embodiment, the central control server 700 includes two databases for storing information on a laundry course of each keyword. The first database 721 and the second database 722 store a variety of text (keyword combinations) inputtable for laundry courses in a table and have laundry courses corresponding thereto.

In one embodiment, information on laundry courses specialized for the corresponding washing machine is stored in the first database 721. Course information which may be provided by the corresponding washing machine is stored for each washing machine. Accordingly, in this case, course setting information may be retrieved based on the identification information of the washing machine.

Meanwhile, information on laundry courses which are not provided by the washing machine is stored in the second database 722. This means standard laundry courses applicable to all washing machines. In this case, the course setting information may be retrieved without the identification information of the washing machine or may be retrieved using a portion of the identification information.

More specifically, the device controller 710 of the central control server 700 extracts the keyword and first determines whether a laundry course specialized for the washing machine is present in the first database 721 using the extracted keyword and the identification information of the washing machine as in step S41 (S37). The course setting information corresponding to the first keyword (StainWord) and the second keyword (ClothWord) is retrieved from the first database 721 in which the course setting information is classified in correspondence with the identification information of the washing machine.

If the corresponding keyword is mapped to the retrieved laundry course, course setting information for controlling the washing machine is derived to set the corresponding course (S38). Examples of the course setting information may include a combination of one or more of the spin of the washing machine, the temperature of water, the type of a detergent, the amount of the detergent or the soil level of the laundry. In addition, a specific course may be selected in the corresponding washing machine. For example, the washing machine has a "boiling" function and, if a result of mapping is "boiling", course setting information indicating "boiling" may be derived.

Meanwhile, if there is no mappable laundry course in the first database 721 as the result of performing the mapping process in S37, S42 is performed. That is, if course setting information corresponding to the identification information of the washing machine and the first and second keywords is not retrieved in S41, the course setting information corresponding to the first keyword and the second keyword is retrieved from the second database 722 in which standard course setting information is stored. That is, the mappable course is retrieved from the second database 722 (S42). As the result of retrieval, the course setting information for controlling the washing machine according to the retrieved course is derived (S38). For example, a laundry method obtained by combining a standard course and options (rinsing, dehydration, water temperature, etc.) may be derived as the course setting information.

If there is no mappable laundry course in the first and second databases 721 and 722, a standard laundry course may be set.

The course setting information may be transmitted to the washing machine. The washing machine may output a message indicating that the washing machine operates audibly (speech guidance or text-to-speech (TTS)) or in the form of text. For TTS output, the TTS unit 520 of the speech server 500 may be used.

The description of FIG. 2*c* is applicable to the configuration of FIG. 1*a*. In addition, as shown in FIG. 1*b*, if the speech recognizer 210, the controller 250 and the TTS unit 220 are disposed in one washing machine 200, the components of the washing machine 200 may exchange information with each other without a separate communication process to derive the course setting information.

Keyword extraction of FIG. 2*c* may be performed by the central control server 700 or the speech server 500. Of course, one server which is a combination of the central control server 700 and the speech server 500 may operate.

For example, the device controller 710 may extract the first keyword and the second keyword from the text file transmitted by the washing machine 100 or the speech server 500.

In addition, when the speech data is received from the washing machine 100 through the communication unit 730 of the central control server 700, a separate speech recognizer disposed in the central control server 700 may convert the speech data into text, thereby extracting the first keyword and the second keyword. In one embodiment, the components of the speech server 500 are included in the central control server 700.

Meanwhile, upon determining that any one of the StainWord or the ClothWord is not input, the device controller 710 of the central control server 700 may generate a message instructing output of a guidance message requesting utterance of the StainWord or the ClothWord, which is not input. When the StainWord "ketchup" is input, the device controller 710 may generate a message instructing output of a guidance message such that a guidance message for confirming the type of the clothes is output as in S26. The communication unit 730 transmits the generated message to the washing machine 100 or the speech server 500 and receives the keyword from the washing machine 100 or the speech server 500. In one embodiment, the received keyword corresponds to any one of the requested StainWord or ClothWord.

Figure 3:
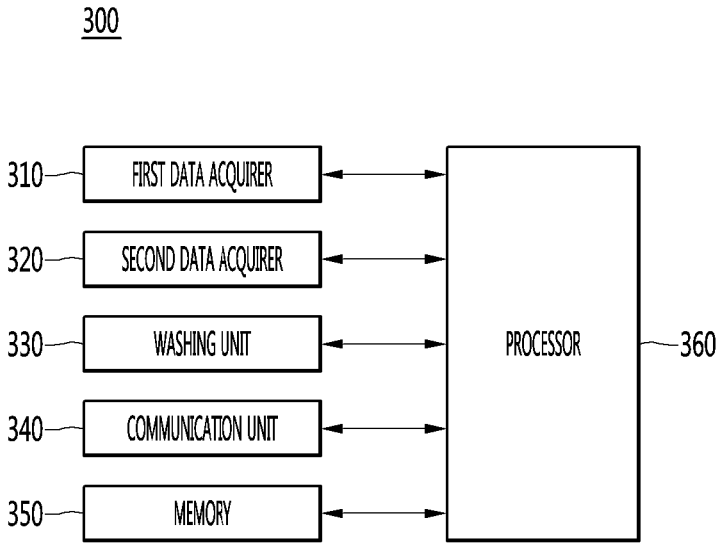
FIG. 3 is a block diagram illustrating a washing machine according to another embodiment of the present invention.

FIG. 3 is a block diagram illustrating a washing machine according to another embodiment of the present invention.

In FIG. 3, the washing machine 300 according to the embodiment of the present invention may include a first data acquirer 310, a second data acquirer 320, a washing unit 330, a communication unit 340 and a memory 350.

The first data acquirer 310 may include at least one of the interface 180 or the speech input unit 110 described in FIG. 1*a* or 1*b* in order to collect data related to the laundry pattern of the user.

The second data acquirer 320 may include the communication unit 130 described in FIG. 1*a* or 2*b*.

Meanwhile, the second data acquirer 320 may include at least one of a wireless Internet module or a short-range communication module.

The wireless Internet module is configured to facilitate wireless Internet access. This module may be installed inside or outside the terminal 100. The wireless Internet module may transmit and/or receive wireless signals via communication networks according to wireless Internet technologies.

Examples of such wireless Internet access include Wireless LAN (WLAN), Wireless Fidelity (Wi-Fi), Wi-Fi Direct, Digital Living Network Alliance (DLNA), Wireless Broadband (WiBro), Worldwide Interoperability for Microwave Access (WiMAX), High Speed Downlink Packet Access (HSDPA), HSUPA (High Speed Uplink Packet Access), Long Term Evolution (LTE), LTE-A (Long Term Evolution-Advanced), and the like.

The wireless Internet module may include a wireless communication circuit for performing wireless communication.

The short-range communication module is configured to facilitate short-range communication and to support short-range communication using at least one of Bluetooth™, Radio Frequency IDentification (RFID), Infrared Data Association (IrDA), Ultra-WideBand (UWB), ZigBee, Near Field Communication (NFC), Wireless-Fidelity (Wi-Fi), Wi-Fi Direct, Wireless USB (Wireless Universal Serial Bus), or the like.

The short-range communication module may include a short-range communication circuit for performing short-range communication.

Meanwhile, the second data acquirer 320 may include a camera.

The camera may capture images. Specifically, the camera may process image frames such as still images or moving images obtained by image sensors. The processed image frames may be stored in the memory 350.

Meanwhile, the second data acquirer 320 may include a tag recognizer. Here, the tag recognizer may include a camera for capturing the tag of the laundry and a tag recognition processor for recognizing characters, symbols, etc. displayed in the tag of the washing machine. Meanwhile, the function of the tag recognition processor may be performed by the processor 360, instead of the tag recognizer.

The second data acquirer 320 may include a sensing unit for sensing surrounding information.

Here, the sensing unit may include at least one of a proximity sensor, an illumination sensor, a touch sensor, an acceleration sensor, a magnetic sensor, a G-sensor, a gyroscope sensor, a motion sensor, an RGB sensor, an infrared (IR) sensor, a fingerprint (finger scan) sensor, an ultrasonic sensor, an optical sensor, a microphone, a battery gauge, an environment sensor (for example, a barometer, a hygrometer, a thermometer, a radiation detection sensor, a thermal sensor, and a gas sensor), or a chemical sensor (for example, an electronic nose, a health care sensor, a biometric sensor, or the like). The washing machine disclosed in this specification may be configured to combine and utilize information obtained from at least two sensors of such sensors.

The second data acquirer 320 may include at last one of the interface 180 or the speech input unit 110 described in FIG. 1*a* or 1*b*, in order to collect detergent information.

Meanwhile, the description of the washing unit 190 of FIG. 1*a* or 1*b* is applicable to the washing unit 330.

The description of the communication unit 130 of FIG. 1*a* or 1*b* is applicable to the communication unit 340. Meanwhile, the communication unit 340 may be connected to another electronic device by wire or wirelessly, thereby performing communication with the electronic device. To this end, the communication unit 340 may include a wired communication circuit or a wireless communication unit.

The memory 350 stores data supporting various functions of the washing machine 300.

The memory 350 may store a plurality of application programs or applications executed in the washing machine 300, data and commands for operation of the washing machine 300, and data for operation of the processor 360 (e.g., at least one piece of algorithm information for machine learning).

The processor 360 may generally control overall operation of the washing machine.

The processor 360 generally controls overall operation of the washing machine 300, in addition to operation related to the application program. The processor 360 may process signals, data, information, etc. input or output through the above-described components or execute the application program stored in the memory 350, thereby processing or providing appropriate information or functions to the user.

In addition, the processor 360 may control at least some of the components described with reference to FIG. 3 in order to execute the application program stored in the memory 350. Further, the processor 360 may operate a combination of at least two of the components included in the washing machine 300, in order to execute the application program.

The processor 360 may be used interchangeably with a controller, a control unit, a microcontroller or a microprocessor.

Meanwhile, the washing machine 300 may include some or all of the components of the device 100 or 200 described in FIG. 1*a* or 1*b* and perform the functions of the components of the device 100 or 200 described in FIG. 1*a* or 1*b*.

In addition, the washing machine 300 may communicate with the speech server 500 and the central control server 700 described in FIG. 1*a*, and perform all functions described in FIG. 1*a*.

Next, artificial intelligence (AI) will be briefly described.

Artificial intelligence (AI) is one field of computer engineering and information technology for studying a method of enabling a computer to perform thinking, learning, and self-development that can be performed by human intelligence and may denote that a computer imitates an intelligent action of a human.

Moreover, AI is directly/indirectly associated with the other field of computer engineering without being individually provided. Particularly, at present, in various fields of information technology, an attempt to introduce AI components and use the AI components in solving a problem of a corresponding field is being actively done.

Machine learning is one field of AI and is a research field which enables a computer to perform learning without an explicit program.

In detail, machine learning may be technology which studies and establishes a system for performing learning based on experiential data, performing prediction, and autonomously enhancing performance and algorithms relevant thereto. Algorithms of machine learning may use a method which establishes a specific model for obtaining prediction or decision on the basis of input data, rather than a method of executing program instructions which are strictly predefined.

In machine learning, a number of machine learning algorithms for classifying data have been developed. Decision tree, Bayesian network, support vector machine (SVM), and artificial neural network (ANN) are representative examples of the machine learning algorithms.

The decision tree is an analysis method of performing classification and prediction by schematizing a decision rule into a tree structure.

The Bayesian network is a model where a probabilistic relationship (conditional independence) between a plurality of variables is expressed as a graph structure. The Bayesian network is suitable for data mining based on unsupervised learning.

The SVM is a model of supervised learning for pattern recognition and data analysis and is mainly used for classification and regression.

The ANN is a model which implements the operation principle of biological neuron and a connection relationship between neurons and is an information processing system where a plurality of neurons called nodes or processing elements are connected to one another in the form of a layer structure.

The ANN is a model used for machine learning and is a statistical learning algorithm inspired from a neural network (for example, brains in a central nervous system of animals) of biology in machine learning and cognitive science.

In detail, the ANN may denote all models where an artificial neuron (a node) of a network which is formed through a connection of synapses varies a connection strength of synapses through learning, thereby obtaining an ability to solve problems.

The term "ANN" may be referred to as "neural network" The ANN may include a plurality of layers, and each of the plurality of layers may include a plurality of neurons. Also, the ANN may include a synapse connecting a neuron to another neuron.

The ANN may be generally defined by the following factors: (1) a connection pattern between neurons of a different layer; (2) a learning process of updating a weight of a connection; and (3) an activation function for generating an output value from a weighted sum of inputs received from a previous layer.

The ANN may include network models such as a deep neural network (DNN), a recurrent neural network (RNN), a bidirectional recurrent deep neural network (BRDNN), a multilayer perceptron (MLP), and a convolutional neural network (CNN), but is not limited thereto.

The ANN may be categorized into single layer neural networks and multilayer neural networks, based on the number of layers.

General single layer neural networks is configured with an input layer and an output layer.

Moreover, general multilayer neural networks is configured with an input layer, at least one hidden layer, and an output layer.

The input layer is a layer which receives external data, and the number of neurons of the input layer is the same the number of input variables, and the hidden layer is located between the input layer and the output layer and receives a signal from the input layer to extract a characteristic from the received signal and may transfer the extracted characteristic to the output layer. The output layer receives a signal from the hidden layer and outputs an output value based on the received signal. An input signal between neurons may be multiplied by each connection strength (weight), and values obtained through the multiplication may be summated. When the sum is greater than a threshold value of a neuron, the neuron may be activated and may output an output value obtained through an activation function.

The DNN including a plurality of hidden layers between an input layer and an output layer may be a representative ANN which implements deep learning which is a kind of machine learning technology.

The ANN may be trained by using training data. Here, training may denote a process of determining a parameter of the ANN, for achieving purposes such as classifying, regressing, or clustering input data. A representative example of a parameter of the ANN may include a weight assigned to a synapse or a bias applied to a neuron.

Such a parameter is an internal parameter and may be determined or updated through training of the ANN.

Other examples of the parameter of the ANN may include the number of layers, the number of neurons, a connection pattern between neurons of different layers, and an activation function for generating an output value by adding a weight to input received from a previous layer. Such a parameter is an external parameter and may be set by the user.

An ANN trained based on training data may classify or cluster input data, based on a pattern of the input data.

In this specification, an ANN trained based on training data may be referred to as a trained model.

Next, a learning method of an ANN will be described.

The learning method of the ANN may be largely classified into supervised learning, unsupervised learning, semi-supervised learning, and reinforcement learning.

The supervised learning may be a method of machine learning for analogizing one function from training data.

Moreover, in analogized functions, a function of outputting continual values may be referred to as regression, and a function of predicting and outputting a class of an input vector may be referred to as classification.

In the supervised learning, an ANN may be trained in a state where a label of training data is assigned.

Here, the label may denote a right answer (or a result value) to be inferred by an ANN when training data is input to the ANN.

In this specification, a right answer (or a result value) to be inferred by an ANN when training data is input to the ANN may be referred to as a label or labeling data.

Moreover, in this specification, a process of assigning a label to training data for learning of an ANN may be referred to as a process which labels labeling data to training data.

In this case, training data and a label corresponding to the training data may configure one training set and may be inputted to an ANN in the form of training sets.

Training data may represent a plurality of features, and a label being labeled to training data may denote that the label is assigned to a feature represented by the training data. In this case, the training data may represent a feature of an input object as a vector type.

An ANN may analogize a function corresponding to an association relationship between training data and labeling data by using the training data and the labeling data. Also, a parameter of the ANN may be determined (optimized) through evaluating the analogized function.

The unsupervised learning is a kind of machine learning, and in this case, a label may not be assigned to training data.

In detail, the unsupervised learning may be a learning method of training an ANN so as to detect a pattern from training data itself and classify the training data, rather than to detect an association relationship between the training data and a label corresponding to the training data. Examples of the unsupervised learning may include clustering and independent component analysis.

Examples of an ANN using the unsupervised learning may include a generative adversarial network (GAN) and an autoencoder (AE).

The GAN is a method of improving performance through competition between two different AIs called a generator and a discriminator. In this case, the generator is a model for creating new data and generates new data, based on original data.

Moreover, the discriminator is a model for recognizing a pattern of data and determines whether inputted data is original data or fake data generated from the generator. Moreover, the generator may be trained by receiving and using data which does not deceive the discriminator, and the discriminator may be trained by receiving and using deceived data generated by the generator. Therefore, the generator may evolve so as to deceive the discriminator as much as possible, and the discriminator may evolve so as to distinguish original data from data generated by the generator. The AE is a neural network for reproducing an input as an output.

The AE may include an input layer, at least one hidden layer, and an output layer.

In this case, the number of node of the hidden layer may be smaller than the number of nodes of the input layer, and thus, a dimension of data may be reduced, whereby compression or encoding may be performed.

Moreover, data outputted from the hidden layer may enter the output layer. In this case, the number of nodes of the output layer may be larger than the number of nodes of the hidden layer, and thus, a dimension of the data may increase, and thus, decompression or decoding may be performed.

The AE may control the connection strength of a neuron through learning, and thus, input data may be expressed as hidden layer data. In the hidden layer, information may be expressed by using a smaller number of neurons than those of the input layer, and input data being reproduced as an output may denote that the hidden layer detects and expresses a hidden pattern from the input data. The semi-supervised learning is a kind of machine learning and may denote a learning method which uses both training data with a label assigned thereto and training data with no label assigned thereto.

As a type of semi-supervised learning technique, there is a technique which infers a label of training data with no label assigned thereto and performs learning by using the inferred label, and such a technique may be usefully used for a case where the cost expended in labeling is large.

The reinforcement learning may be a theory where, when an environment where an agent is capable of determining an action to take at every moment is provided, the best way is obtained through experience without data.

The reinforcement learning may be performed by a Markov decision process (MDP).

The Markov Decision Process (MDP) will be briefly described. First, an environment including information necessary for the agent to take a next action is given. Second, what action is taken by the agent in that environment is defined. Third, a reward given to the agent when the agent successfully takes a certain action and a penalty given to the agent when the agent fails to take a certain action are defined. Fourth, experience is repeated until a future reward reaches a maximum point, thereby deriving an optimal action policy.

Meanwhile, an artificial neural network in which a parameter is determined or continuously updated by performing learning through reinforcement learning may be referred to as a reinforcement learning model in this specification.

Figure 4:
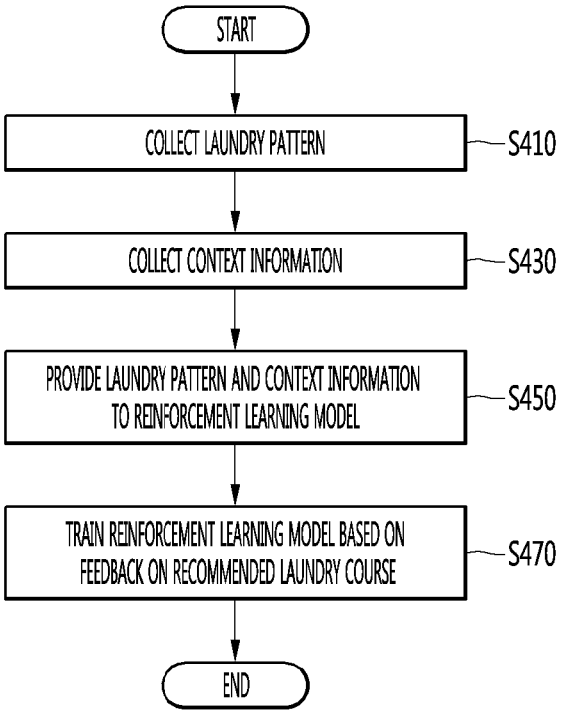
FIG. 4 is a flowchart illustrating a method of operating a washing machine according to an embodiment of the present invention.

FIG. 4 is a flowchart illustrating a method of operating a washing machine according to an embodiment of the present invention.

The method of operating the washing machine 300 according to the embodiment of the present invention may include step S410 of collecting data related to a laundry pattern, step S430 of collecting data related to context information, step S450 of providing the laundry pattern of a user and the context information to a reinforcement learning model as an environment and step S470 of training the reinforcement learning model using feedback of thee user on a recommended laundry course when the reinforcement learning model recommends the laundry course.

Steps S410 and S430 will be described with reference to FIGS. 5 and 6.

Figure 5:
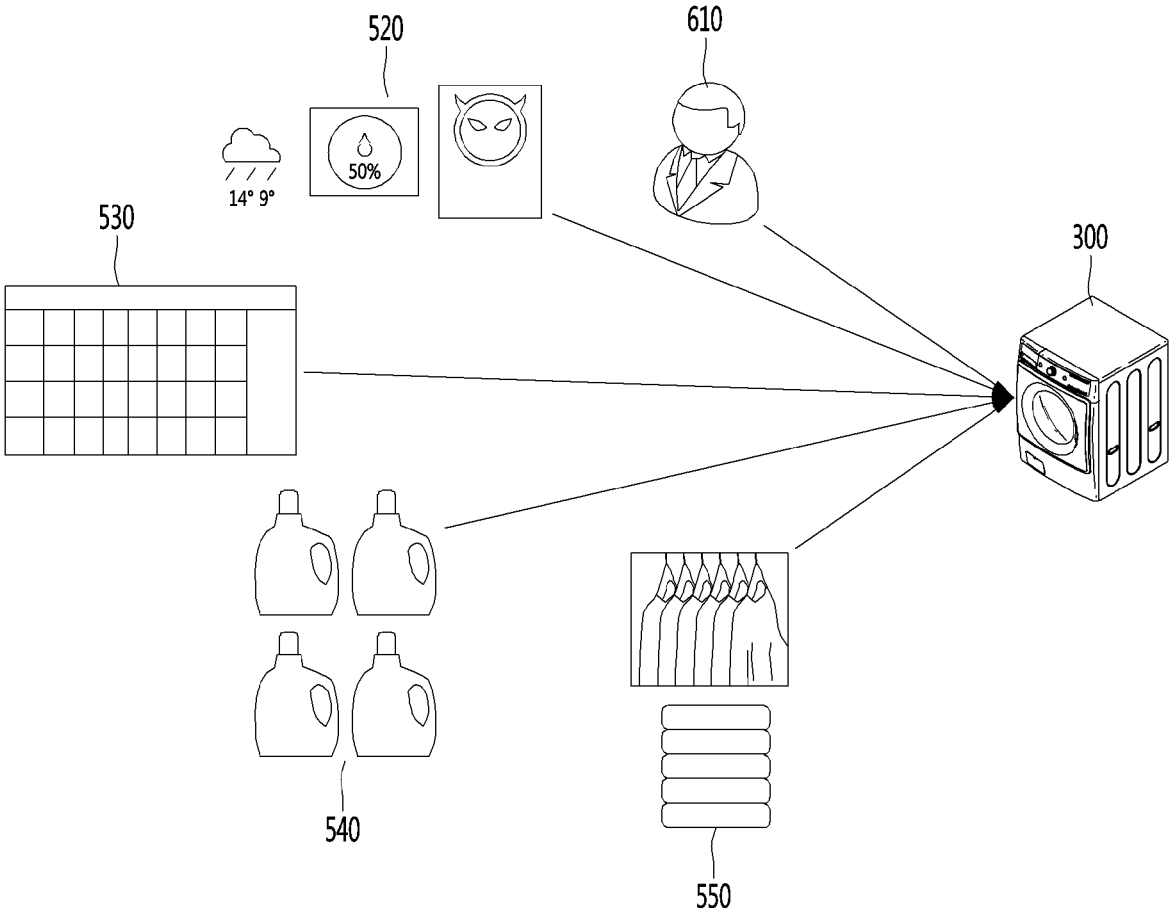
FIG. 5 is a diagram illustrating a method of collecting data related to a laundry pattern and data related to context information.

FIG. 5 is a diagram illustrating a method of collecting data related to a laundry pattern and data related to context information.

The first data acquirer 310 may collect the data related to the laundry pattern of the user 610.

The laundry pattern of the user may include at least one of the laundry course selected by the user or elements configuring the laundry course.

The laundry course is set by the manufacturer of the washing machine or is directly generated by the user and may mean a normal laundry course, a wool course, a bedclothes course, a user specific course, etc.

The user specific course may be generated by correcting some elements of the course set by the manufacturer of the washing machine or combining elements configuring the laundry course by the user.

The elements configuring the laundry course may include a water temperature, the number of washes, a washing time, the number of rinses, a rinsing time, the number of times of dehydration, a dehydration time or the amount of detergent.

Meanwhile, when the first data acquirer 310 collects the data related to the laundry pattern of the user, the processor 360 may acquire the laundry pattern of the user using the collected data and store the laundry pattern in the database of the memory 350.

The laundry pattern of the user may mean the preferred laundry pattern of the user. Specifically, the processor may acquire the preferred laundry pattern of the user using the history of the washing machine used by the user. In this case, the processor may store the preferred laundry pattern of the user in the database.

The second data acquirer 320 may collect the data related to the context information.

Here, the context information may include at least one of laundry, a surrounding environment, a user condition, a detergent or another user's preferred pattern.

The laundry 550 may include a laundry type (pants, a towel, socks, a jumper, a coat, etc.), laundry characteristics (cloth (cotton, wool, knitwear), a size, an individual weight, etc.), a total weight of laundry put by the user, etc. The second data acquirer 320 may acquire data related to laundry through at least one of a weight sensor, a camera or a tag recognizer.

In addition, the surrounding environment 520 may include date, time, day of the week, season, indoor humidity, indoor temperature, etc. The second data acquirer 320 may directly acquire data related to the surrounding environment through the sensing unit or receive the date related to the surrounding environment from a server, an Internet-of-things device or another electronic apparatus through a short-range communication module or a wireless Internet model.

In addition, the user condition 530 may include user health, recent schedule, etc. The second data acquirer 320 may be connected to a user's account (calendar, mail account, etc.) through the wireless Internet module to receive data related to the user condition.

In addition, the detergent information 540 may include detergent properties, type, concentration, etc. The second data acquirer 320 may collect data related to the detergent information input by the user through the interface or the speech input unit or receive the data related to the detergent information from the server through the wireless Internet module.

In addition, another user's preferred pattern may include another user's laundry pattern, a washing time according to the laundry pattern, cleanliness of the laundry after washing, energy consumption, user satisfaction, etc., in a situation having similar context information. The second data acquirer 320 may receive data related to another user's preferred pattern from the server through the wireless Internet module.

Meanwhile, when the second data acquirer 320 collects data related to the context information, the processor 360 may acquire context information using the collected data.

FIG. 6 is a view illustrating a method of collecting a laundry pattern of each user.

Since there may be several members in one home, the washing machine 300 may be used by a plurality of users 610, 620 and 630.

In addition, as shown in FIG. 6*a*, requirements of the plurality of users 610, 620 and 630 for the laundry course may be different.

For example, a user A who is a busy office worker may prefer quick washing and a user B who a housewife responsible for the health of the family may prefer clean washing. In addition, a user C who frequently takes exercise may prefer washing capable of eliminating smell of sweat.

In this case, the processor may acquire and store a plurality of laundry patterns respectively corresponding to the plurality of users.

Specifically, the processor may recognize a specific user among the plurality of users using data collected through the first data acquirer.

For example, speech data of the user A 610, speech data of the user B 620 and speech data of the user C 630 may be collected through the first data acquirer. In this case, the processor may distinguish among the plurality of users based on characteristics of the speech data received from the plurality of users.

When the speech data is received, the processor may determine who is the user who has uttered the speech data based on the characteristics of the received speech data.

When data related to the laundry pattern is collected from the speech data, the processor may acquire the laundry pattern of the user using the data related to the laundry pattern and store information on matching between the acquired laundry pattern and the user who has uttered the speech data, along with the acquired laundry pattern.

In this manner, the processor may store the laundry pattern of the user A corresponding to the user A, the laundry pattern of the user B corresponding to the user B and the laundry pattern of the user C corresponding to the user C in the database.

Meanwhile, the processor may recognize the specific user among the plurality of users using the data collected through the first data acquirer and acquire the laundry pattern of the specific user.

Specifically, when the speech data is received, the processor may determine who is the user who has uttered the speech data based on the characteristics of the received speech data, retrieves the database, and acquire the laundry pattern corresponding to the user who has uttered the speech data.

Next, step S450 of providing the laundry pattern of the user and the context information to the reinforcement learning model as an environment, which is described in FIG. 4, will be described in detail.

The processor may provide the laundry pattern of the user and the context information to the reinforcement learning model.

If a plurality of users uses a washing machine, the processor may recognize a specific user among the plurality of users using data collected through the first data acquirer and provide the laundry pattern of the specific user and context information to the reinforcement learning model.

In this case, the processor may preprocess the laundry pattern of the user and the context information and provide the preprocessed laundry pattern of the user and the preprocessed context information to the reinforcement learning model.

This will be described with reference to FIGS. 7 and 8.

FIG. 7 is a view illustrating a preprocessing procedure of a laundry pattern. FIG. 7*a* shows a data table before preprocessing and FIG. 7*b* shows a data table after preprocessing.

The processor may preprocess the laundry pattern.

Specifically, the processor may perform preprocessing in a manner of one-hot vectorizing a discrete value. The discrete value may mean a categorizable value such as the number of washes, the number of rinses, the number of times of boiling, a preferred course, etc.

Meanwhile, the processor may perform preprocessing by normalizing a continuous value to a value between 0 and 1. Here, the continuous value may mean a continuous value such as a washing time, a water temperature, etc.

Figures 8, 9:
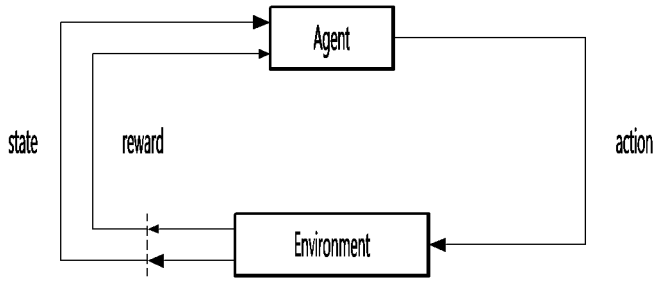
FIG. 8 is a view illustrating a preprocessing procedure of context information.
FIG. 9 is a view illustrating a reinforcement learning method of the present invention.

FIG. 8 is a view illustrating a preprocessing procedure of context information. FIG. 8*a* shows a data table before preprocessing and FIG. 8*b* shows a data table after preprocessing.

The processor may preprocess the context information.

Specifically, the processor may perform preprocessing in a manner of one-hot vectorizing a discrete value. The discrete value in the context information may include the type of laundry cloth, whether the washing machine is capable of washing the laundry, whether the laundry is hand-washed, the type of a detergent usable in the laundry, whether the laundry is capable of being boiled, day of the week, season, weather, schedule, user's health (high, middle and low), the type of the detergent currently used in the washing machine, or characteristics of the detergent currently used in the washing machine.

Meanwhile, the processor may perform preprocessing by normalizing a continuous value to a value between 0 and 1. The continuous value in the context information may include a temperature of water capable of washing the laundry, a current time, a current humidity, a current temperature, a detergent concentration, energy consumption in another user's preferred course, user satisfaction in another user's preferred course, a degree of contamination after washing in another user's preferred course, a washing time in another user's preferred course, etc.

Meanwhile, the processor may provide the laundry pattern of the user and the context information to the reinforcement learning model as an environment. In this case, the reinforcement learning model may recommend a laundry course.

This will be described in detail with reference to FIG. 9.

FIG. 9 is a view illustrating a reinforcement learning method of the present invention.

The reinforcement learning model may be installed in the washing machine 300.

Meanwhile, the reinforcement learning model may be implemented in hardware, software or a combination thereof. If a portion or whole of the reinforcement learning model is implemented in software, one or more commands configuring the reinforcement learning model may be stored in the memory 350.

Reinforcement learning is a theory that an agent can find the best way through experience without data when an environment in which the agent may decide what action is taken every moment is given.

Reinforcement learning may be performed by a Markov decision process (MDP).

The Markov Decision Process (MDP) will be briefly described. First, an environment including information necessary for the agent to take a next action is given. Second, what action is taken by the agent in that environment is defined. Third, a reward given to the agent when the agent successfully takes a certain action and a penalty given to the agent when the agent fails to take a certain action are defined. Fourth, experience is repeated until a future reward reaches a maximum point, thereby deriving an optimal action policy.

When the Markov Decision Process is applied to the present invention, the agent may mean the washing machine, and, more particularly, the reinforcement learning model.

In addition, first, in the present invention, an environment including information necessary for the agent to take a next action, that is, the laundry pattern of the user and the context information, maybe given to the agent (the reinforcement learning model).

Second, in the present invention, what action is taken by the agent (the reinforcement learning model) using the given washing information and context information, that is, which laundry course is recommended, may be determined.

Third, a reward may be defined as being given to the agent when the agent recommends a laundry course desired by the user and a penalty may be defined as being given to the agent when the agent does not recommend a laundry course desired by the user. In this case, the agent (the reinforcement learning model) may update the parameter of the neural network based on the reward and the penalty.

Fourth, the agent (the reinforcement learning model) repeats experience until a future reward reaches a maximum point, thereby recommending an optimal policy, that is, a most desired laundry course of the user.

The reinforcement learning method according to the present invention will be described in detail with reference to FIG. 10.

Figure 10:
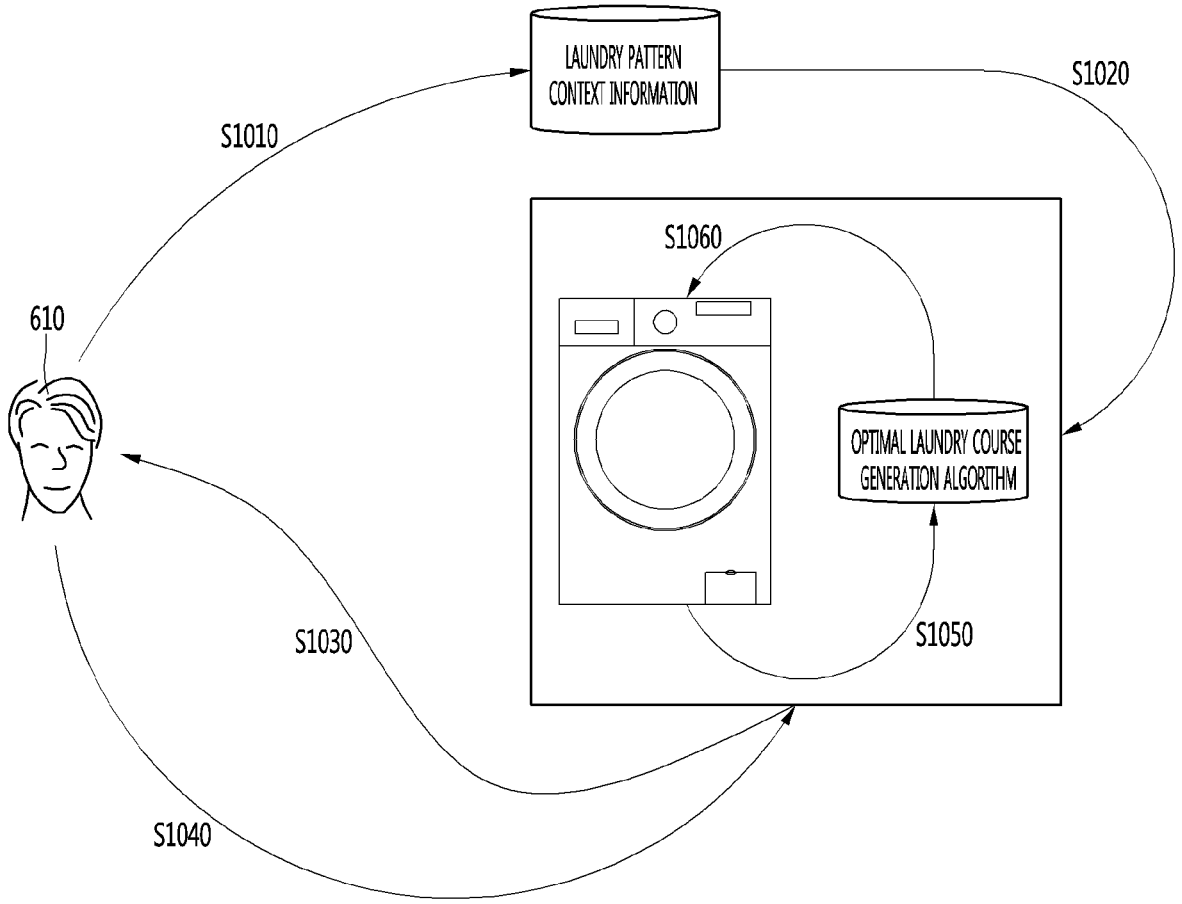
FIG. 10 is a view illustrating a reinforcement learning method according to an embodiment of the present invention.

FIG. 10 is a view illustrating a reinforcement learning method according to an embodiment of the present invention.

First, the processor may receive user input through the first data acquirer (S1010).

In this case, the processor may recognize a specific user among a plurality of users using input and acquire a laundry pattern corresponding to the specific user.

In this case, the processor may provide the acquired laundry pattern and context information to the reinforcement learning model as an environment. That is, the processor may input the acquired laundry pattern and the context information to the reinforcement learning model 1090 (S1020).

In this case, the reinforcement learning model 1090 may recommend a laundry course based on the laundry pattern and the context information.

Meanwhile, the reinforcement learning model may be pre-trained.

Here, pre-training may mean that the reinforcement learning model has performed prior learning by the manufacturer. In this case, the reinforcement learning model which has performed prior learning may be installed when the washing machine is released or may be transmitted from a server to the washing machine to replace the existing reinforcement learning model.

When the reinforcement learning model is pre-trained, the speed of reinforcement learning and performance of the reinforcement learning model may be very rapidly increased.

This will be described in greater detail with reference to FIG. 13.

The reinforcement learning model may recommend various laundry courses in consideration of the laundry pattern of the user and the context information.

For example, when a laundry pattern in which the user A prefers quick washing is indicated and the laundry is a dress shirt, the reinforcement learning model may recommend laundry course A suitable for washing of a dress shirt and capable of quick washing. As another example, when a laundry pattern in which the user B prefers clean washing is indicated and the laundry is a dress shirt, the reinforcement learning model may recommend laundry course B suitable for washing of a dress shirt and capable of clean washing. In this case, laundry course A may include 10-minute washing, 2 rinses, and 5-minute dehydration, and laundry course B may include 15-minute washing, three rinses, and 5-minute dehydration.

As another example, when a laundry pattern in which the user C prefers a boiling function is indicated and the laundry is bedclothes, the reinforcement learning model may recommend a laundry course with the boiling function. When a laundry pattern in which the user D prefers a dusting function is indicated and the laundry is bedclothes, the reinforcement learning model may recommend a laundry course with the dusting function instead of the boiling function.

As another example, when a user E prefers a boiling function and a T-shirt with less dust on the outside thereof is washed, the reinforcement learning model may recommend a laundry course with the boiling function. When the user D prefers a boiling function and a T-shirt with a lot of fine dust on the outside thereof is washed, the reinforcement learning model may recommend a laundry course with the boiling function and the dusting function.

As another example, if a user F prefers quick washing, the reinforcement learning model may recommend laundry course C capable of quick washing. However, if the user F washes laundry immediately after exercise based on the schedule of the user F acquired from the calendar, the reinforcement learning model may recommend a laundry course obtained by adding a function for eliminating smell of sweat to laundry course C.

Such examples are only examples of simplifying various laundry patterns and context information. Due to characteristics of the neural network, the reinforcement learning model may recommend an optimal laundry course by combining various elements.

Meanwhile, the reinforcement learning model may give a higher weight to the laundry pattern than the context information, thereby recommending a laundry course.

Specifically, referring to the above description of the laundry pattern and the context information, elements configuring the context information is much more than elements configuring the laundry pattern of the user.

Accordingly, if the same weight is given to the elements configuring the laundry pattern and the elements configuring the context information, it may be difficult to recommend a laundry course differentiated according to the laundry patterns of the plurality of users.

Accordingly, the reinforcement learning model may set a parameter to give a higher weight to the laundry pattern than the context information. In addition, the reinforcement learning model may give a higher weight to the laundry pattern than the context information according to the set parameter, thereby recommending a laundry course.

Meanwhile, when the reinforcement learning model recommends the laundry course, the processor may output information on the recommended laundry course (S1030).

Specifically, the processor may display or audibly output the recommended laundry course and detailed information of the laundry course.

Meanwhile, the processor may receive feedback of the user on the recommended laundry course (S1040).

For example, when a laundry course is recommended based on the laundry pattern of the user A and the context information, the processor may receive speech input, button input, touch input, etc. of the user A as feedback.

In this case, the processor may train the reinforcement learning model using the feedback of the user on the recommended laundry course.

Specifically, the processor may provide the reinforcement learning model with the reward or penalty corresponding to the received feedback (S1050). In this case, the reinforcement learning model may establish a new policy based on the reward or the penalty and update a parameter to correspond to the new policy (S1060).

Next, a method of providing feedback to the reinforcement learning model will be described in detail.

Figure 11:
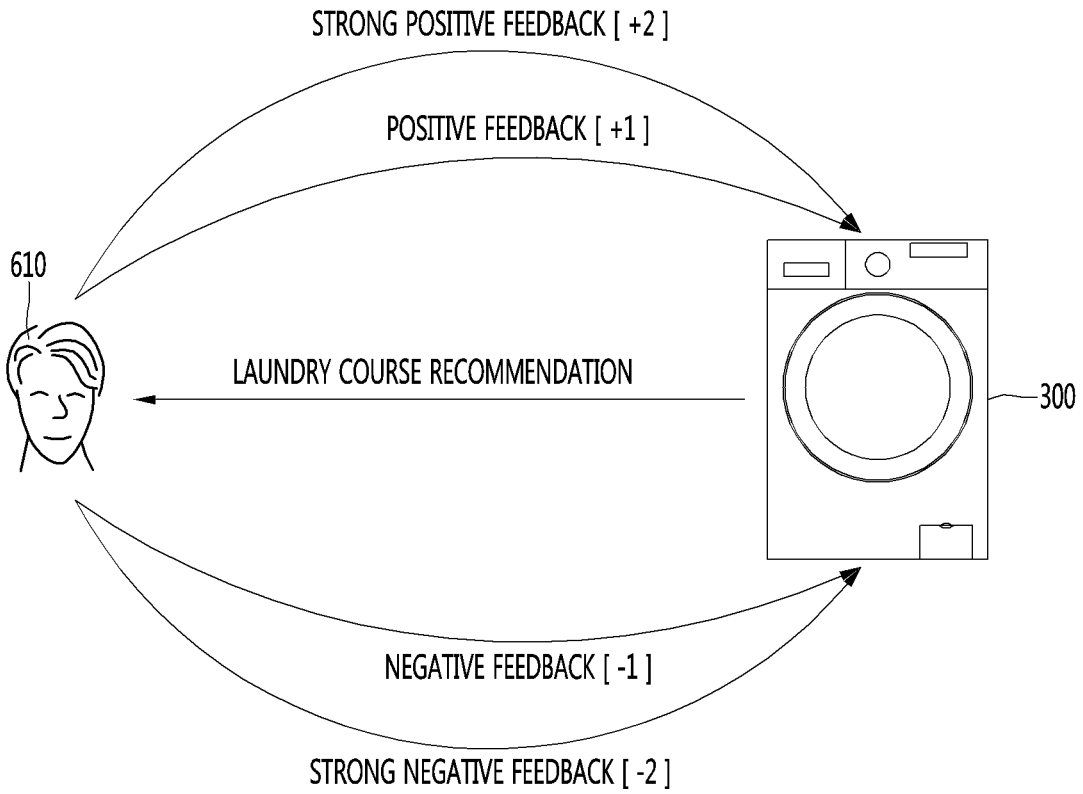
FIG. 11 is a view illustrating a method of providing feedback to a reinforcement learning model according to an embodiment of the present invention.

FIG. 11 is a view illustrating a method of providing feedback to a reinforcement learning model according to an embodiment of the present invention.

The feedback may include positive feedback indicating a positive response to the laundry course recommended by the reinforcement learning model and negative feedback indicating a negative response.

Here, the positive feedback may include selection, retrieval, storage or reselection of the recommended laundry course.

Here, selection of the recommended laundry course may be reception of a command for executing the recommended laundry course. For example, this may mean that, when the washing machine outputs "Would you like to wash laundry according to Course A including Element a, Element b and Element c, user input of "Yes" is received.

In addition, storage may reception of a command for storing the recommended laundry course. For example, this may mean that, when the washing machine recommends Course A, user input of "Store that course" is received.

Retrieval may reception of a command for retrieving the laundry course recommended in the past. For example, this may mean that the washing machine recommended Course A in the past, the recommended Course A remains in a history, and user input of displaying detailed information of Course A is received.

Reselection may be reception of a command for reselecting the laundry course recommended in the past. For example, this may mean that the washing machine recommended Course A in the past, the recommended Course A remains in a history, and user input of washing laundry according to Course A is received.

Meanwhile, the negative feedback may include non-selection, cancellation, deletion or non-use setting of the recommended laundry course.

Here, non-selection of the recommended laundry course may reception of a command not to execute the recommended laundry course. For example, this may mean that, when the washing machine outputs "Would you like to wash laundry according to Course A including Element a, Element b and Element c, user input of "No" is received.

In addition, cancellation of the recommended laundry course may be reception of a command for interrupting execution of the recommended laundry course. For example, this may mean that, the washing machine outputs "Would you like to wash laundry according to Course A including Element a, Element b and Element c and washes laundry according to Course A, but user input of "Stop washing and wash laundry according to another course" is received.

In addition, deletion may be reception of a command for deleting the laundry course recommended in the past from the history. For example, this may mean that the washing machine recommended Course A in the past, the recommended Course A remains in a history, and user input of deleting the recommended Course A from the history is received.

In addition, non-use setting may be reception of a command not to recommend the recommended laundry course again. For example, this may mean that the washing machine has recommended Course A and user input of "Do not recommend Course A in the future" is received.

Meanwhile, the processor may give a reward to the reinforcement learning model when the feedback of the user is positive feedback, and give a penalty to the reinforcement learning model when the feedback of the user is negative feedback.

Meanwhile, the processor may give different levels of rewards according to the strength of the positive feedback.

Specifically, the processor may give a reward of a first level (e.g., +1) to the reinforcement learning model if the positive feedback is selection of the recommended laundry course and give a reward of a second level (e.g., +2) greater than the first level to the reinforcement learning model if the positive feedback is retrieval, storage or reselection of the recommended laundry course.

For example, selection of the recommended laundry course indicates simple acceptance and has low strength. In contrast, retrieval, storage or reselection of the recommended laundry course indicates willingness of the user to reuse the recommended laundry course and has a high strength.

Accordingly, the processor may give different levels of rewards according to the strength of the positive feedback, and the reinforcement learning model may perform reinforcement learning based on the level of the reward.

Meanwhile, the processor may give different levels of penalties according to the strength of the negative feedback.

Specifically, the processor may give a penalty of a third level (e.g., −1) to the reinforcement learning model when the negative feedback is non-selection of the recommended laundry course, and give a penalty of a fourth level (e.g., −2) greater than the third level to the reinforcement learning model when the negative feedback is deletion, cancellation or non-use setting of the recommended laundry course.

For example, non-selection of the recommended laundry course indicates simple rejection and has a low strength. In contrast, deletion, cancellation or non-use setting of the recommended laundry course indicates willingness of the user not to reuse the recommended laundry course and has a high strength.

Accordingly, the processor may give different levels of penalties according to the strength of the negative feedback and the reinforcement learning model may perform reinforcement learning based on the level of the penalty.

Meanwhile, after washing is finished, the processor may receive feedback from the user. Specifically, after washing is finished, the user may evaluate the laundry process (a washing time, cleanliness of laundry, energy consumption, etc.).

Accordingly, after washing is finished, the processor may receive feedback from the user and give the reward or penalty corresponding to the feedback.

In this case, the processor may receive the feedback through the first data acquirer. In addition, when the user inputs a degree of satisfaction using a mobile terminal, the processor may receive the feedback through a communication unit communicating with the mobile terminal.

Meanwhile, after washing is finished, the processor may output or store washing information such as a washing time, cleanliness of laundry, energy consumption, etc.).

Meanwhile, when negative feedback is received from the user, the processor may give a higher weight to the laundry pattern of the user, thereby recommending a laundry course.

Specifically, the context information is objective information generally applicable to all users, rather than reflecting user's tendency. That is, recommendation of the laundry course according to the context information is derived by reflecting the objective situation and performing many experiments and simulations at the manufacturer.

Accordingly, receiving the negative feedback from the user means that the recommended laundry course is highly likely to not to be suitable for the laundry pattern of the user than the context information.

Accordingly, when the negative feedback is received from the user, the processor may give a higher weight to the laundry pattern of the user, thereby recommending a laundry course.

In another embodiment, if the frequency of receiving negative feedback from the user is increased or negative feedback is received from the user a predetermined number of times or more, the processor may give a higher weight to the laundry pattern of the user, thereby recommending a laundry course.

Figure 12:
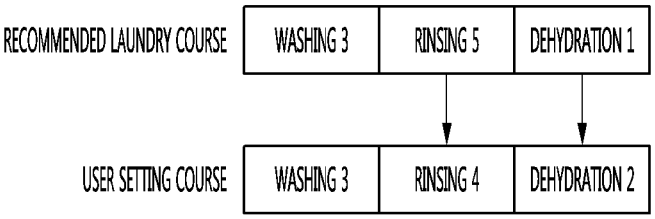
FIG. 12 is a view illustrating an operation method in the case where a laundry course is newly set after receiving negative feedback.

FIG. 12 is a view illustrating an operation method in the case where a laundry course is newly set after receiving negative feedback.

A new laundry course may be set after negative feedback on the recommended laundry course is received from the user.

For example, the washing machine may output "I recommend Course A" and receive user input of "No. Please wash laundry according to Course B".

In another example, the washing machine may output "I recommend Course A", but the user may directly set elements (a washing time, the number of rinses, a dehydration time, etc.) configuring the laundry course. In this case, after implicit negative feedback is received, the user directly sets the laundry course.

If the new laundry course is set after negative feedback on the recommended laundry course is received from a specific user, the processor may update a preferred laundry pattern of the user using a difference between the recommended laundry course and the newly set laundry course.

For example, referring to FIG. 12, the user decreased the number of rinses by one and increased the number of times of dehydration by one. In this case, the processor may update the preferred laundry pattern of the user using such a difference.

According to the present invention, it is possible to recommend a laundry course optimized for a current situation considering the laundry preference of the user.

According to the present invention, since various levels of rewards or penalties are given using the responses of various users as feedback, it is possible to accurately reflect user preference to perform reinforcement learning and to recommend a laundry course.

According to the present invention, by continuously performing reinforcement learning whenever the user performs washing, it is possible to continuously enhance performance of the reinforcement learning model.

Figure 13:
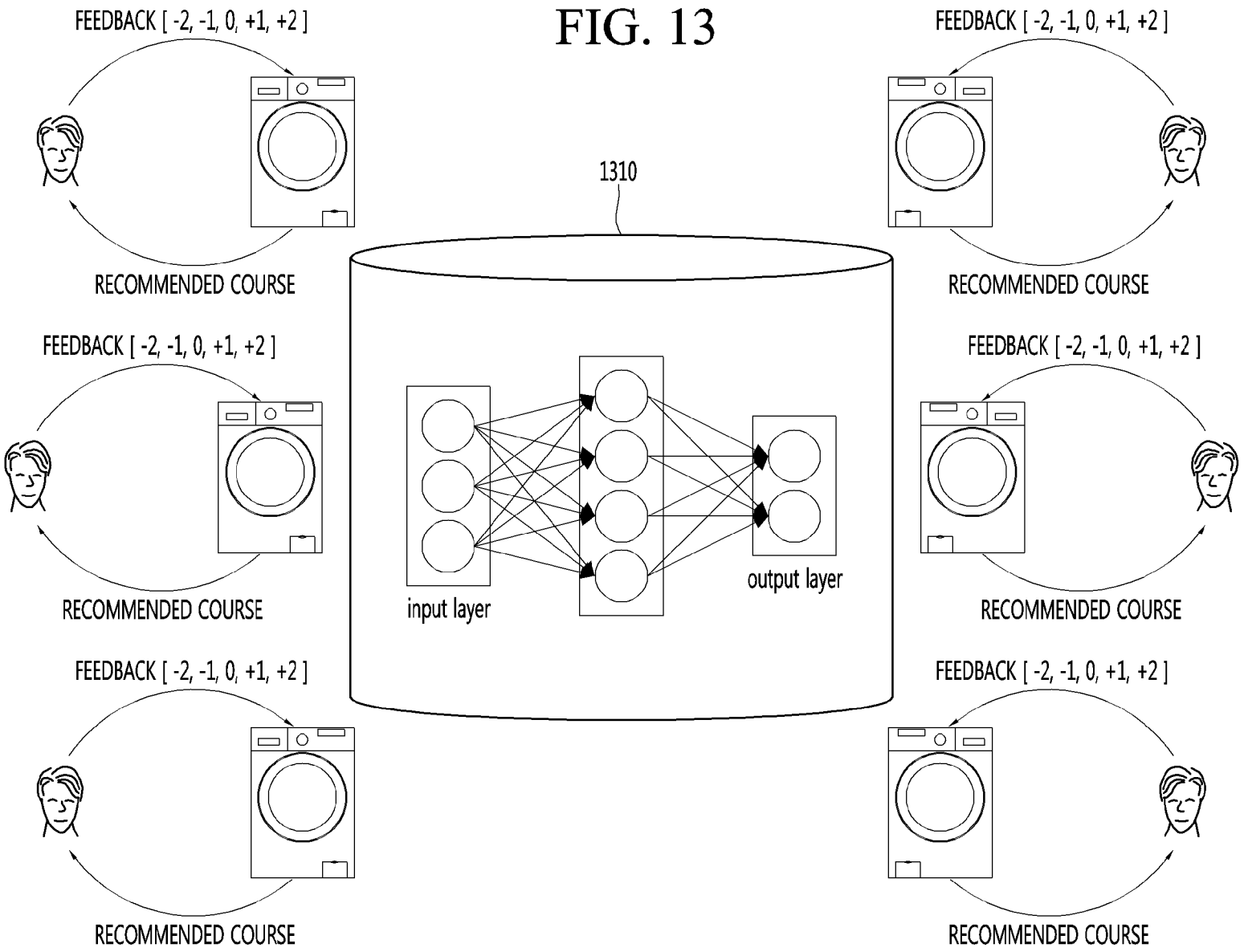
FIG. 13 is a view illustrating a method of pre-training a reinforcement learning model according to an embodiment of the present invention.

FIG. 13 is a view illustrating a method of pre-training a reinforcement learning model according to an embodiment of the present invention.

The reinforcement learning model installed in the washing machine may be pre-trained. Here, pre-training may mean that the reinforcement learning model has performed prior learning by the manufacturer or another organization.

Meanwhile, the reinforcement learning model may be pre-trained through reinforcement learning using the laundry patterns of a plurality of users, context information and feedback acquired based on a cloud service.

Specifically, the cloud server 1310 may receive the laundry pattern, the context information and the feedback on the recommended laundry course input to the reinforcement learning model when washing.

In this case, the cloud server 1310 provides the laundry patterns of the plurality of users and the context information to the reinforcement learning model as an environment and train the reinforcement learning model using the feedback corresponding to the provided laundry pattern and the context information.

When the reinforcement learning model is pre-trained in this manner, the pre-trained reinforcement learning model may be newly installed in the washing machine or may replace the existing reinforcement learning model in the washing machine.

In the method of pre-training the reinforcement learning model, since learning data exponentially increases, it is possible to recommend a laundry course more suitable for the laundry pattern of the user and the context information after the reinforcement learning model is installed in the washing machine and to shorten a time required for learning.

Meanwhile, the method of pre-training the reinforcement learning model is not limited to prior learning based on the cloud service.

Specifically, the reinforcement learning model may be pre-trained using the context information.

Specifically, the server may provide context information to a neural network to train the reinforcement learning model.

In this case, supervised learning or reinforcement learning may be used.

For example, the server may train the reinforcement learning model through supervised learning of a manner of labeling specific context information with a specific laundry course.

In another example, the server may provide context information to the reinforcement learning model as an environment and train the reinforcement learning model in a manner of giving a reward or a penalty to action (recommendation of the laundry course) of the reinforcement learning model.

When the reinforcement learning model is pre-trained in this manner, the pre-trained reinforcement learning model may be newly installed in the washing machine or may replace the existing reinforcement learning model in the washing machine.

Providing the laundry pattern of the specific user as the environment is possible only after the reinforcement learning model is installed in the washing machine. Learning using environmental information is possible even before the reinforcement learning model is installed in the washing machine.

Accordingly, according to the present invention, by pre-training learning possible even before the reinforcement learning model is installed, it is possible to recommend a laundry course more suitable for the laundry pattern of the user and the context information after the reinforcement learning model is installed in the washing machine and to shorten a time required for learning.

For example, the reinforcement learning model first installed in the washing machine after being pre-trained using the context information cannot recommend a laundry course considering the laundry pattern of the specific user but can recommend an optimal laundry course considering the context information. Thereafter, since the parameter is gradually corrected using the laundry pattern of the specific user, it is possible to shorten a learning time.

Meanwhile, when a plurality of users uses the washing machine, the reinforcement learning model may include reinforcement learning models respectively corresponding to the plurality of users.

For example, when the user A uses the washing machine, the processor may recommend a laundry course using a first reinforcement learning model corresponding to the user A and train the first reinforcement learning model using feedback of the user A.

In another example, when the user B uses the washing machine, the processor may recommend a laundry course using a second reinforcement learning model corresponding to the user B and train the second reinforcement learning model using feedback of the user B.

Figure 14:
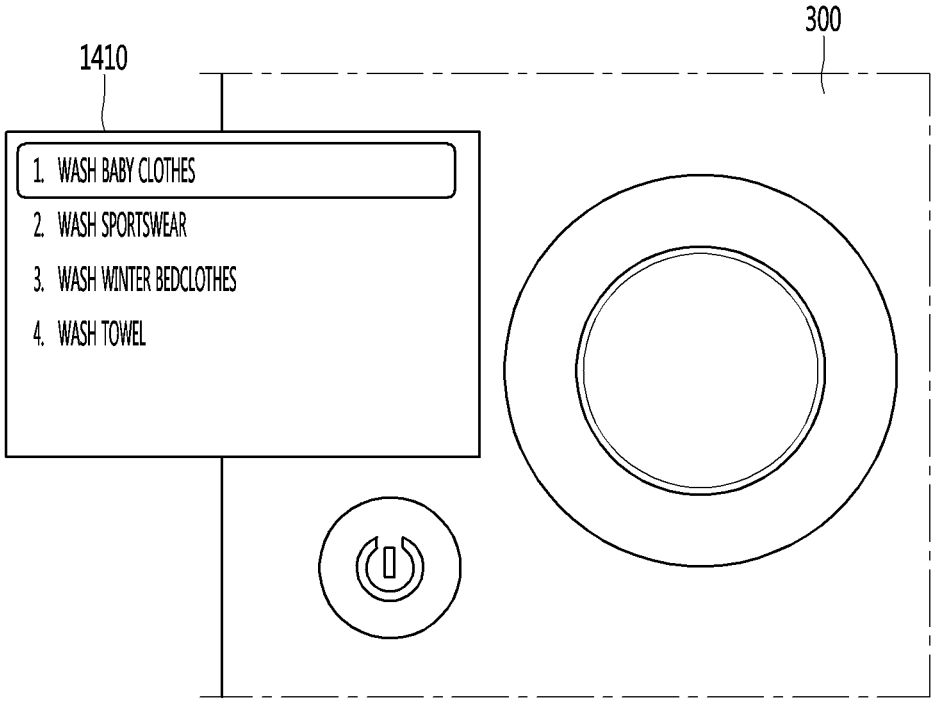
FIG. 14 is a view illustrating a laundry course service according to an embodiment of the present invention.

FIG. 14 is a view illustrating a laundry course service according to an embodiment of the present invention.

The processor may provide a laundry course service.

In this case, the laundry course service may include course recommendation, laundry course retrieval of a user, retrieval of season, cloth or functional apparel, downloading and adding courses to the washing machine, confirmation of a course added to a laundry course selection dial list 1410, washing according to a selected course, feedback of the user on the course, course deletion or correction, sharing or uploading of a corrected course, changing the order of courses, a default course immediately selected when a start button is pressed, or automatic course classification according to use frequency.

Meanwhile, a plurality of washing machines may be connected based on a cloud and may share information on preferred courses in situations similar to the current laundry and situation (laundry/surrounding environment/weather/user condition) with other users.

In addition, information on a washing time, cleanliness of laundry after washing/energy consumption/satisfaction may be shared with other users.

In addition, the cloud server may transmit preferred courses of users to the washing machine.

Specifically, the users of the washing machines may share user's per-course preferences for season/weather/cloth/weight/detergent and preferred courses through social networking such as applications.

In this case, the cloud server may transmit preferred laundry courses of the users to the washing machine and the washing machine may display or audibly output such laundry courses.

In this case, the washing machine may align and display favorite courses (preferred courses) from the top.

In addition, when the user selects a laundry course received from the server, the processor may perform washing according to the selected laundry course.

According to the present invention, it is possible to recommend a laundry course optimized for the current situation and considering the laundry tendency of the user.

According to the present invention, by giving various levels of rewards or penalties using responses of various users as feedback, it is possible to accurately reflect the tendency of the user to perform reinforcement learning and to recommend a laundry course.

According to the present invention, by continuously performing reinforcement learning whenever a user performs washing, it is possible to continuously enhance performance of the reinforcement learning model.

The present invention mentioned in the foregoing description may be implemented using a machine-readable medium having instructions stored thereon for execution by a processor to perform various methods presented herein. Examples of possible machine-readable mediums include HDD (Hard Disk Drive), SSD (Solid State Disk), SDD (Silicon Disk Drive), ROM, RAM, CD-ROM, a magnetic tape, a floppy disk, an optical data storage device, the other types of storage mediums presented herein, and combinations thereof. If desired, the machine-readable medium may be realized in the form of a carrier wave (for example, a transmission over the Internet). The processor may include the controller 180 of the mobile terminal.

The foregoing embodiments are merely exemplary and are not to be considered as limiting the present disclosure. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A washing machine, comprising:

one or more sensors;

one or more processors configured to:

obtain a laundry pattern of a user;

obtain context information via the one or more sensors, wherein the obtained context information is related to a particular operation event of the washing machine by the user;

provide the obtained laundry pattern and the obtained context information to a reinforcement learning model associated with the user; and obtain a recommended operation setting of the washing machine for the particular operation event provided by the reinforcement learning model based on the laundry pattern and the context information;

determine feedback of the user for the recommended operation setting; and provide the determined feedback to the reinforcement learning model to further train the model associated with the user; and a wireless communication unit, wherein:

the context information comprises at least personal information of the user received via the wireless communication unit which includes a scheduled event of the user prior to a time of the particular operation event; and the recommended operation setting is selected to effectively clean clothing items worn by the user during the scheduled event.

2. The washing machine of claim 1, wherein the context information further comprises a plurality of data points and one or more of the plurality of data points is obtained via the wireless communication unit.

3. The washing machine of claim 1, wherein the context information further comprises at least a type of laundry item for the particular operation event, information on an environment of the washing machine, information on a laundry detergent for the particular operation event, or a laundry pattern of a similar user.

4. The washing machine of claim 3, wherein the personal information of the user further includes at least information on a health of the user, schedule information of the user, e-mail history of the user, or a purchase history of the user.

5. The washing machine of claim 3, wherein the information on the environment of the washing machine comprises a least information on a date, time, day of the week, season, temperature, or humidity associated with the particular operation event of the washing machine.

6. The washing machine of claim 1, further comprising a memory, wherein the obtained laundry pattern of the user is based on information, stored in the memory, of a plurality of previous operations of the washing machine associated with the user.

7. The washing machine of claim 6, further comprising a microphone, wherein the one or more processors are further configured to:

receive a voice input from the user via the microphone for setting the washing machine for the particular operation event;

identify the user based on voice recognition of the received voice input; and obtain the laundry pattern from the memory based on the identification of the user based on voice recognition.

8. The washing machine of claim 1, wherein the feedback of the user comprises one of a positive reinforcement resulting from the user selecting the recommended operation setting for the particular operation event or a negative reinforcement resulting from the user selecting another operation setting for the particular operation event.

9. The washing machine of claim 8, wherein the one or more processors are further configured to update stored preferences of the user based on a difference between the recommended laundry course and selected another operation setting.

* * * * *